United States Patent [19]

Isoda

[11] Patent Number: 4,654,477

[45] Date of Patent: Mar. 31, 1987

[54] ELECTRIC CONDUCTOR

[75] Inventor: Yukitomo Isoda, Toyonaka, Japan

[73] Assignees: Osaka Fuji Kogyo Co., Ltd., Amagasaki; Nippon Light Metal Co., Ltd., Tokyo, both of Japan

[21] Appl. No.: 676,906

[22] Filed: Nov. 30, 1984

[30] Foreign Application Priority Data

Dec. 1, 1983 [JP] Japan ..... 58-227515

[51] Int. Cl.[4] ..... H01B 5/08

[52] U.S. Cl. ..... 174/128 R; 174/129 R; 174/129 S; 174/130

[58] Field of Search ..... 174/128 R, 129 R, 129 S, 174/130; 57/200, 212, 213, 218; 428/652, 674, 931

[56] References Cited

U.S. PATENT DOCUMENTS

| | | | |
|---|---|---|---|
| 1,334,257 | 3/1920 | Partington | 174/129 R |
| 2,098,162 | 11/1937 | Reed | 174/128 R |
| 2,387,829 | 10/1945 | Burnham et al. | 57/212 |
| 2,930,918 | 3/1960 | Coffin, Jr. | 174/128 R |
| 2,975,075 | 3/1961 | Beese | 427/49 |
| 3,164,670 | 1/1965 | Ege | 174/128 R |
| 3,231,715 | 1/1966 | Hall | 219/275 |
| 3,234,722 | 2/1966 | Gilmore | 174/128 R |
| 3,624,276 | 11/1971 | Rawlins | 174/129 R |
| 4,538,023 | 8/1985 | Brisson | 174/115 |

FOREIGN PATENT DOCUMENTS

| | | | |
|---|---|---|---|
| 905155 | 1/1954 | Fed. Rep. of Germany | 174/129 R |
| 451898 | 4/1913 | France | 174/128 R |

*Primary Examiner*—Arthur T. Grimley
*Assistant Examiner*—Morris H. Nimmo
*Attorney, Agent, or Firm*—Cushman, Darby & Cushman

[57] ABSTRACT

The electric conductor comprises at least three kinds of element wires which are electrically connected with each other at least at their both ends, and the electric conductor performs a superior signal transmission characteristics for audio signal and so on.

2 Claims, 19 Drawing Figures

ELECTRIC CONDUCTOR

BACKGROUND OF THE INVENTION

1. Field of the Invention

The present invention relates to an improvement in construction of an electric conductor which can transmit a signal, for example, an also signal or a computer signal.

2. Description of the Prior Art

Hitherto, an electric conductor, for example, an electric wire used for transmitting electric energy with small transmission loss, is usually made of copper. The reason to use copper is that copper is second to silver in smallness of specific resistance among many existing electric conductor materials.

When the electricity is utilized as energy, the smallness of electric power loss is a significant condition for such electric wire mentioned above, and therefore, it is reasonable copper material to be used generally as the material of the electric wire for economically transmitting the electric power.

When the electricity is utilized as a signal, however, not only the electric power loss is significant but also the following conditions should be satisfied.

(1) Complicated and various signal wave forms need to be transmitted.

(2) A signal having a great change from a faint signal to an intense signal needs to be transmitted.

(3) A signal having a wide frequency band from a direct current signal or a low frequency signal to a high frequency signal needs to be transmitted.

(4) In each of the above-mentioned signal transmission, the original signal needs to be transmitted faithfully with high reliability.

Hitherto, it has been believed that such material as having small specific resistance can be dealt with the above-mentioned conditions in the same manner as for the electric power transmission.

However, in the conventional method, it is very difficult, for example, in audio signal transmission to improve an ear-accessed distortion, tone quality, rise-up characteristills, frequency characteristics, resolution and so on at the same time.

The inventor found that there are various inherent electric characteristics other than the specific resistance responding to various kinds of electric conductors. For exmaple, FIG. 1, FIG. 2, FIG. 3 and FIG. 4 show the frequency characteristics of wires of copper, brass, aluminum and lead, respectively. As apparent from comparison of FIG. 1 to FIG. 4, each electric conductor has inherent electric characteristics with respect to the frequency characteristics. As a result, the widely used copper wire is not necessarily superior to other material as the electric conductor material for transmitting electric signals. That is, wire of copper has the inherent electric signal transmission characteristics like wire of other materials. The inventor has made many kinds of experiments to find whether there are any wires having more superior transmission characteristics than that of the copper, by trially combining wires of various kinds of materials. Thus, inventor completed the present invention.

SUMMARY OF THE INVENTION

The present invention intends to provide an electric conductor which has a superior signal transmission characteristics to the conventional electric signal conductors made with fundamentally single material.

Electric conductor of the present invention comprises at least three different kinds of element wires of non-ferrous material or of non-metal conductor and the element wires being electrically connected with each other at least at their both ends.

In the present invention, the word "element wire" is defined as an elementary conductor, and the sectional shape thereof is not limited to a circle, but includes any shapes, such as fan shape, any shape made by segmenting a circle, rectangle, triangle, etc.

BRIEF EXPLANATION OF THE DRAWING

FIG. 5(*b*) is a sectional view of a part of electric conductor of an embodiment of the present invention, in which element wires of several different kinds of conductor materials having different diameters with each other are combined together.

DESCRIPTION OF THE PREFERRED EMBODIMENT

Figure 1:
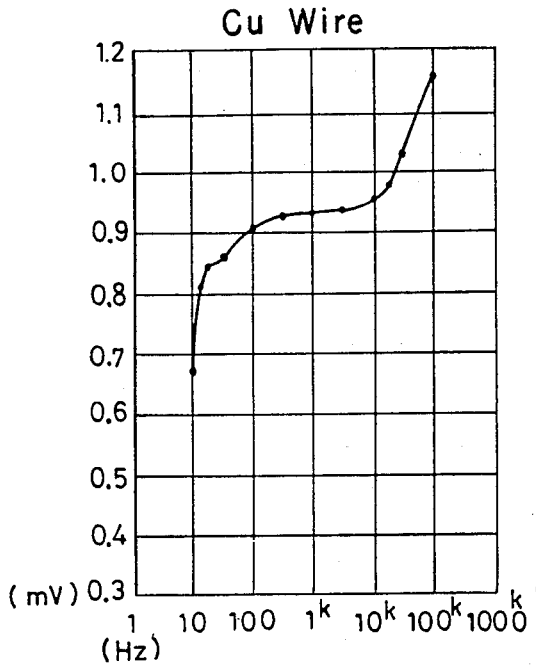
FIG. 1 is a diagram showing a frequency characteristics of copper wire.
Figure 2:
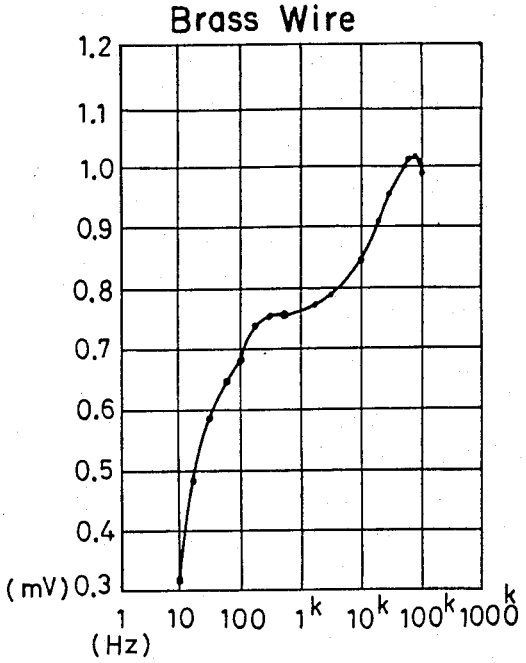
FIG. 2 is a diagram showing a frequency characteristics of brass wire.
Figure 3:
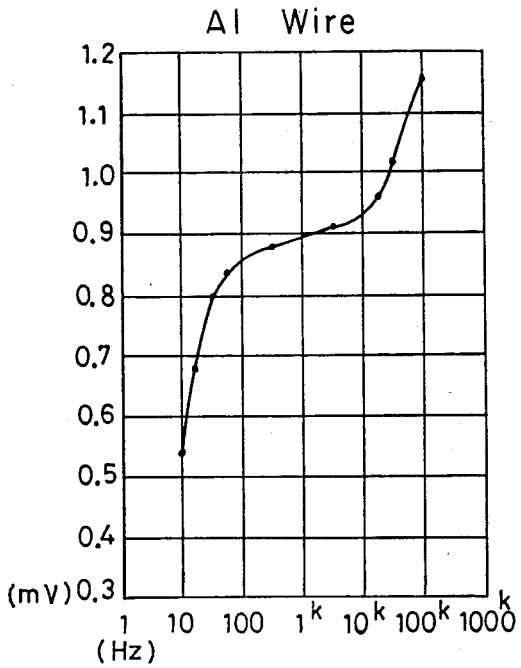
FIG. 3 is a diagram showing a frequency characteristics of aluminum wire.
Figure 4:
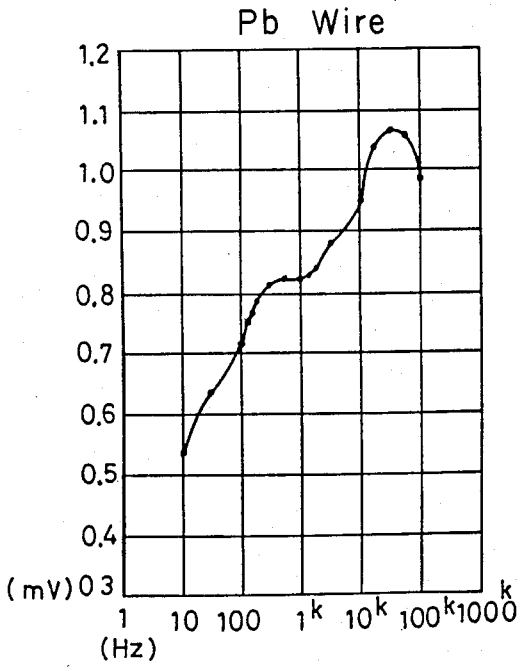
FIG. 4 is a diagram showing a frequency characteristics of lead wire.
Figure 5:
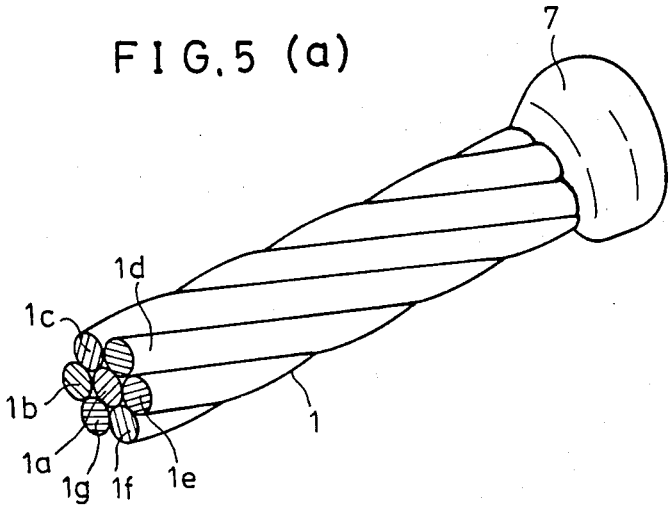
FIG. 5(*a*) is a perspective view showing a part of electric conductor of an embodiment of the present invention, in which element wires of several different kinds of conductor materials are twisted together.
Figure 5:
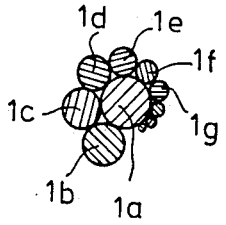

An electric conductor of the present invention comprises at least three different kinds of element wires 1*a*, 1*b*, 1*c*, . . . made of non-ferrous metal or non-metallic conductive material metal as shown in FIG. 5 to FIG. 11. The element wires 1*a*, 1*b*, 1*c* . . . are electrically connected with each other at least at their ends. The element wires of non-metallic conductive material means that the material is not metal, but any electric conductive material, for example, of carbon or doped germanium or doped mixed crystal such as GaAsAl, and so on. The number of the different kinds of element wires 1*a*, 1*b*, 1*c*, . . . is not less than three; for example, the electric conductor comprises seven strands as shown in FIG. 5(*a*) or fourteen strands as in the below-mentioned example of experiment.

In the embodiment of FIG. 5(*a*), the electric conductor is formed by twisting an element wire 1*a* of lead, element wires 1*b*, 1*e* of over, element wires 1*c*, 1*f* of aluminum and element wires 1*d*, 1*g* of brass. Ends of corresponding sides of these element wires 1*a*, 1*b*, 1*c*, . . . are electrically connected with each other by soldering or press-bonding or the like known means. In FIG. 5(*a*), only one soldered part 7 is shown. The section areas of the element wires 1*a*, 1*b*, . . . can be different with each other as shown in FIG. 5(*b*). The larger the intensity hence, shorter the pitch of the twisting is, the better the audio signal transmission characteristics becomes. Incidentally in an electric conductor consisting only of Cu-wires, the audio signal transmission characteristics of the electric conductor becomes better when the diameters of the copper element wires are different with each other.

Figure 6:
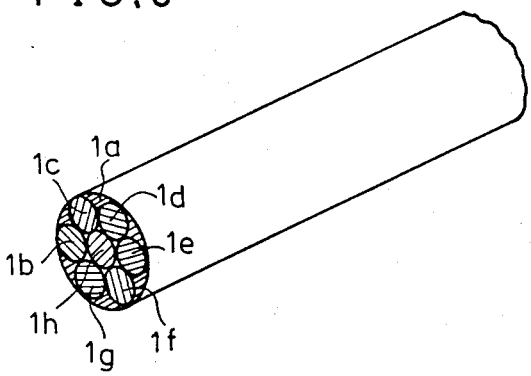
FIG. 6 is a perspective view showing a part of an embodiment of the present invention, in which lead is filled up into the gap between the element wires.

In the embodiment of FIG. 6, the central element wire 1*h* is made of carbon and lead is filled up into the gaps among the element wires 1*b*, 1*c*, 1*d*, 1*e*, 1*f*, 1*g*.

Figure 7:
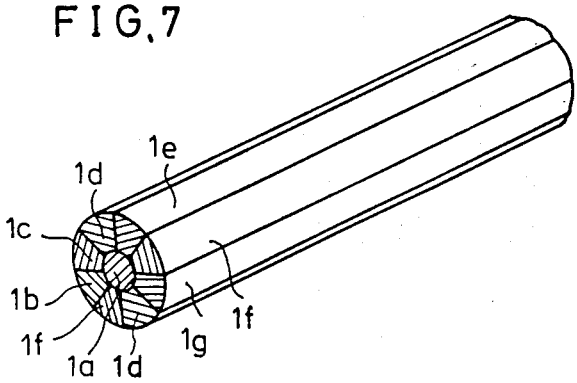
FIG. 7 is a perspective view showing a part of electric conductor of an embodiment of the present invention, in which several different kinds of elementary wires are press-bonded with each other thereby to form an integrated electric conductor.

In the embodiment of FIG. 7, the element wires 1*a*, 1*b*, 1*c*, 1*d*, 1*e*, 1*f*, 1*g* are press-bonded with each other, for example, by being pressed when worked through a die or dies so that the gap between neighboring element wires is nil.

Figure 8:
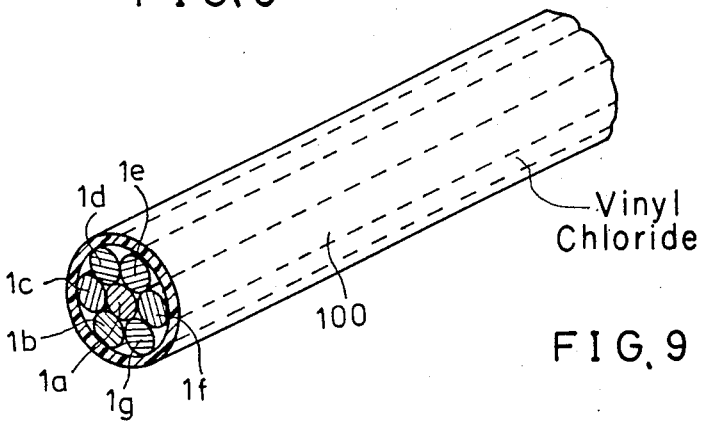
FIG. 8 is a perspective view showing a part of electric conductor of an embodiment of the present invention, in which a bunch of several different kinds of element wires are covered with a tube of vinyl chloride or the like plastic material.

In the embodiment of FIG. 8, the element wires 1*a*, 1*b*, 1*c*, . . . which are not twisted with each other, are covered with a tube member or a coating 100 such as vinyl chloride.

In the embodiments of FIG. 6 to FIG. 8, the section areas of the element wires 1*a*, 1*b*, 1*c*, . . . are not necessarily equal with each other and the sectional shape is not necessarily circular, but may be any shape such as ellipse or rectangle and the like. In each of the above-mentioned embodiments, the element wires are disposed almost in parallel.

Figure 9:
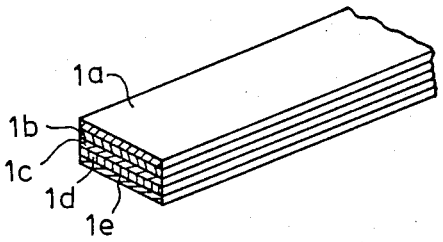
FIG. 9 is a perspective view showing a part of electric conductor of an embodiment of the present invention, in which several different kinds of flat type elementary wires are combined together.

As shown in the embodiment of FIG. 9, the shape of the electric wires 1*a*, 1*b*, 1*c*, 1*d*, 1*e* may be flat belt shape.

Figure 10:
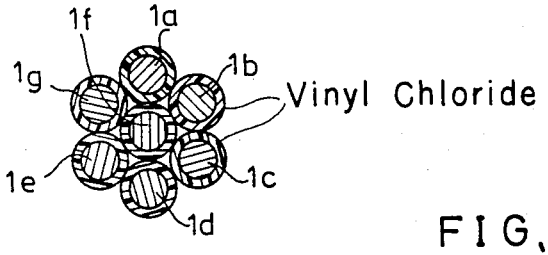
FIG. 10 is a sectional view of a part of electric conductor of an embodiment of the present invention, in which each element wire is covered with coating of vinyl chloride layer.

In the embodiment of FIG. 10, each element wire 1*a*, 1*b*, 1*c*, 1*d*, 1*e*, 1*f*, 1*g* is covered with tube or coating of such as vinyl chloride.

Figure 11:
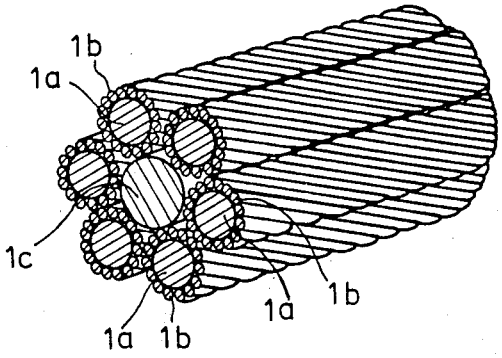
FIG. 11 is a perspective view showing a part of electric conductor of an embodiment of the present invention, in which each thick element wires are wound with several thin element wires.

In the embodiment of FIG. 11, many pieces of element wires 1*b*, 1*b*, 1*b*, . . . are wound on other kind of element wire 1*a*, and such element wires 1*a*, 1*a*, . . . are arranged to surround an element wire 1*c*.

Figure 12:
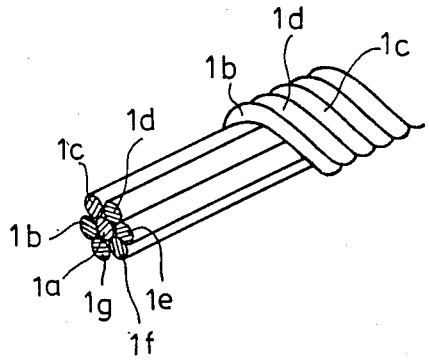
FIG. 12 is a perspective view showing a part of electric conductor of an embodiment of the present invention, in which several different kinds of element wires are wound around a bundle consisting of several different kinds of element wires.

In the embodiment of FIG. 12, seven element wires 1*a*, 1*b*, 1*c*, 1*d*, 1*e*, 1*g*, 1*f* are bundled together and a copper element wire 1*b*, an aluminum element wire 1*c* and a brass element wire 1*d* are wound around the bundled element wires 1*a*, 1*b*, . . . . In the embodiment, a vibration which is likely occur when a signal transmits the electric conductor is effectively prevented.

Figure 13:
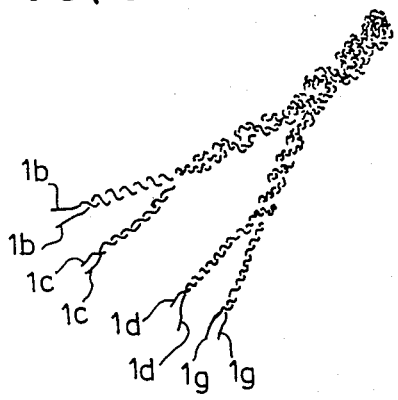
FIG. 13 is a perspective view showing a part of electric conductor of an embodiment of the present invention, in which plural element wires are twisted thereby forming a unit wire, and plural unit wires are further twisted to form an integral electric conductor, with its end parts disintegrated for illustration of the structure.

In the embodiment of FIG. 13, two element wires of copper 1*b*, 1*b* are twisted together and two element wires of aluminum 1*c*, 1*c* are twisted together. The resultant twisted element wires 1*b*, 1*b* of copper and the resultant twisted element wires 1*c*, 1*c* of aluminum are further twisted together. Furthermore, other twisted element wires 1*d*, 1*d*, 1*g*, 1*g* formed in the same manner as above and the above-mentioned further twisted element wires 1*b*, 1*b*, 1*c*, 1*c* in the same manner are again twisted together thereby forming four-wire-electric conductor. In this embodiment, the vibration is much prevented.

Incidentally, though not illustrated, three or more element wires may be firstly twisted together instead of the above-mentioned firstly twisting of two element wires.

As mention above, since the electric conductor of the present invention comprises at least three different kinds of element wires each having different inherent signal transmission characteristics, the inherent particularities of the signal transmission characteristics of several different element wires cooperate or are averaged. Therefore, the audio signal transmission characteristics, namely, earaccessed distortion, tone quality, rise-up characteristics, frequency characteristics, resolution and so on are improved. The selection of the kinds of the element wires can be made considering the frequency characteristics, tone quality and so on.

The experiment for showing the superior audio transmission characteristics of the electric conductor of the present invention, is as follows.

Figure 14:
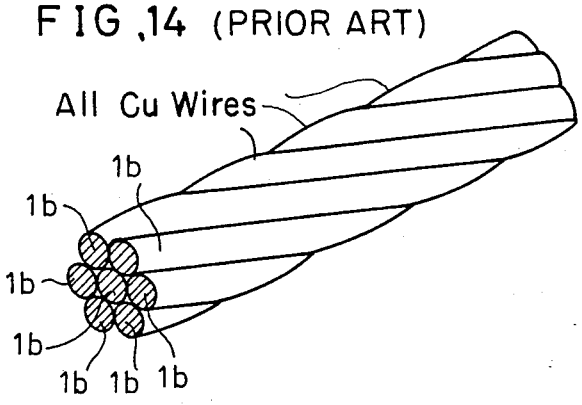
FIG. 14 (PRIOR ART)
FIG. 14 is a perspective view showing a part of conventional electric wire comprised only of copper element wires, shown as a comparison example.
Figure 15:
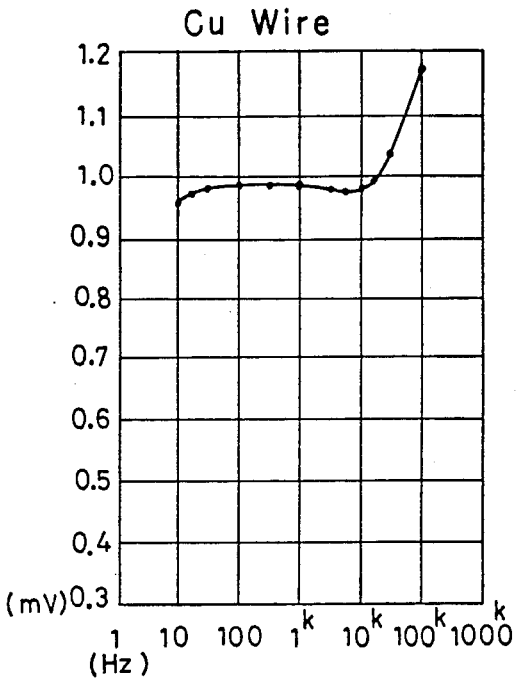
FIG. 15 is a diagram showing a frequency characteristics of the comparison example of FIG. 14.
Figure 16:
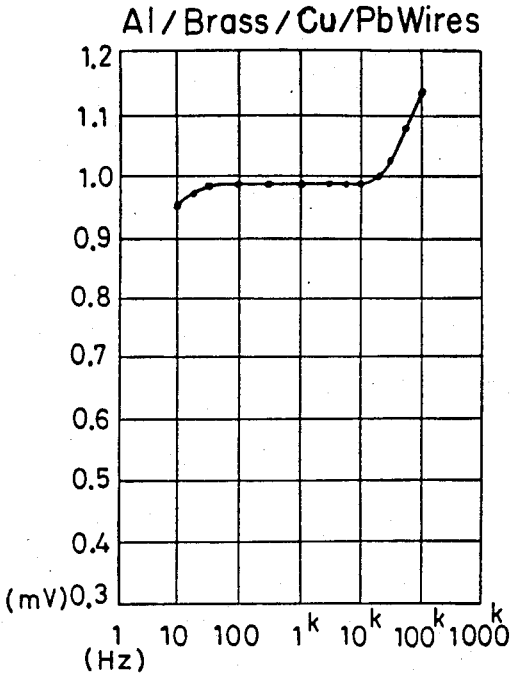
FIG. 16 is a diagram showing a frequency characteristics of the conventional electric conductor of the present invention.
Figure 17:
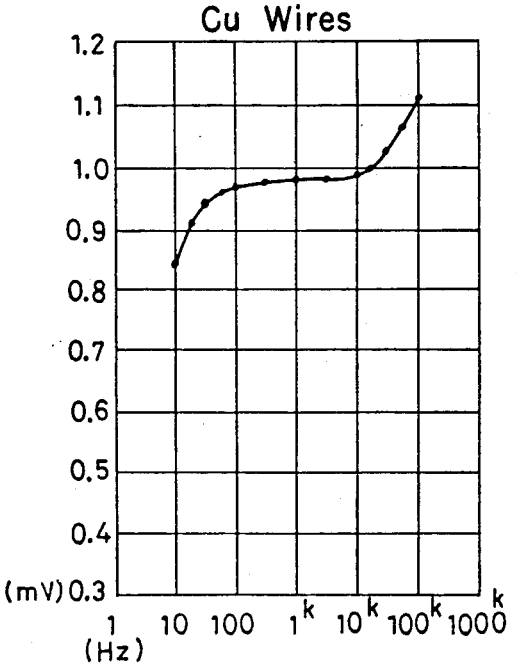
FIG.17 (PRIOR ART)
FIG. 17 is a diagram showing a frequency characteristics of a conventionel electric wire for audio signal sold in the market as a comparison example.
Figure 18:
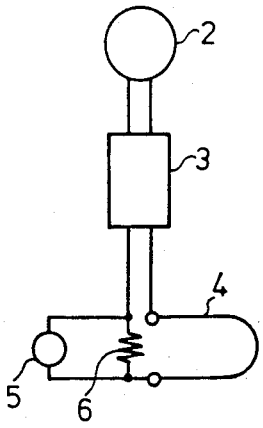
FIG. 18 is a circuit diagram showing an electric circuit which is used in the experiments to obtain the frequency characteristics of the electric conductor of the present invention and the comparison examples.

FIG. 14 shows a sample of a conventional electric wire for comparison composed only of copper element wires 1*b*, 1*b*, 1*b*, . . . , wherein the conditions of the twisting, size, shape, number of pieces and so on are same as the conditions in FIG. 5(*a*). Though FIG. 5(*a*) and FIG. 14 illustrate the configuration of the electric conductor in a simplified mode for easy illustration providing only seven element wires. However, in the actual embodiments and the comparison example, number of element wires are fourteen in both cases. In the actual comparison example case, each copper element wire 1*b* has 0.5 mm$\phi$ diameter and 10 m length, and the copper element wires are twisted together to form the electric conductor of FIG. 5. In the actual embodiment electric conductor of FIG. 5, four aluminum element wires, four brass element wires, four copper element wires, two lead element wires, each element wires having 0.5 mm$\phi$ diameter and 10 m length, are twisted together, to form the electric conductor of the present invention. As a result of the experiments of the comparison example electric conductor in FIG. 14 and the embodiment electric conductor of the present invention in FIG. 5(*a*), the frequency characteristics of the comparison example electric conductor is shown in FIG. 15 and the frequency characteristics of the embodiment electric conductor of the present invention is shown in FIG. 16. As is apparent from the comparison of FIG. 15 and FIG. 16, the frequency characteristics of the electric conductor of the present invention is superior to that of the sample electric conductor. For reference, the frequency characteristics of a conventional audio signal electric conductor comprising 0.18 mmϕ×28 strands×10 m length of copper wires each covered with vinyl chloride coating, which is sold in the market, is shown in FIG. 17. FIG. 18 shows an electric circuit which was used in the above-mentioned experiment. In FIG. 18, a signal oscillator 2 is connected to an amplifier 3 which issued 1 mV voltage signal. The above-mentioned embodiment electric conductor comparison example electric conductor 4 and a series resistor 6 are connected in series across the input terminals of the amplifier 3, so that an output voltage is generated across both ends of the series resistor 6. A vacuum tube voltmeter 5 detects the voltage across both ends of the resistor 6.

Further, the inventor executed an organic or effective or function examination to test the function or performance of the electric conductor of the present invention.

Inventor selected a music signal as an electric signal for the experiment, since the contents of the music signal has wide variety of signal and the music signal is familiar and easy for audience of the experiment, so that they can recognize easily the effect of the electric conductor of the present invention. In the experiments, the electric conductors were tested as speaker cords, since the music signal transmission characteristics is liable to be influenced by the speaker cords and therefore the effect of the electric conductor of the present invention is easy to be recognized.

The organic or function examination of the electric conductor of the present invention was executed for twenty-five audiences who have audio apparatuses and usually are listening to music.

The result of the organic or function examination is shown in the following table.

| Opinion of audiences | Number of audiences | % |
|---|---|---|
| Very good | 13 | 52 |
| Good | 6 | 24 |
| Narrowly good | 5 | 20 |
| Bad | 0 | 0 |
| Can not judge | 1 | 4 |

As apparent from the above-mentioned organic or function examination, it was proved that in case of using the electric conductor of the present invention, the feeling of the music does not show queer characteristics unlike that of the copper electric conductor or that of the aluminum electric conductor, and the music was felt as if natural tone. And, the audiences could clearly recognize the music and fine variations of the music.

The electric conductor of the present invention is utilized for transmitting the audio signal, for example, 20 Hz to 50 KHz signal but can be utilized also for transmitting other electric signal. For example, the electric oonductor of the present invention is usable for electric conductors to transmit electric signal of a computer circuit.

As above-mentioned, the electric conductor of the present invention has extremely superior electric characteristics to the conventional copper or silver electric conductor while using known and inexpensive material.

What is claimed is:

1. Electric signal transmission conductor comprising;

a bundle of plural electric signal transmission element wires having at least three different kinds of frequency characteristics with regard to an electric signal transmission, said plural electric signal transmission element wires being of at least one substance selected from the group consisting of non-ferrous material or materials and electrically conductive non-metallic material or materials, and said element wires being electrically connected with each other at least at opposite ends to form one electric signal transmission path therealong between said ends.

2. Electric signal transmission conductor in accordance with claim 1, wherein said element wires are selected from the group consisting of at least lead element wires, aluminum element wire, copper element wire and brass element wire.

* * * * *